US010046346B2

(12) United States Patent
Knorr et al.

(10) Patent No.: US 10,046,346 B2
(45) Date of Patent: Aug. 14, 2018

(54) DISPENSER FOR CONCENTRATED CLEANING SOLUTION

(71) Applicant: COLGATE-PALMOLIVE COMPANY, New York, NY (US)

(72) Inventors: Joseph R. Knorr, East Brunswick, NJ (US); Michael Amoafo, Bridgewater, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/258,500

(22) Filed: Sep. 7, 2016

(65) Prior Publication Data

US 2017/0173612 A1 Jun. 22, 2017

Related U.S. Application Data

(60) Provisional application No. 62/269,414, filed on Dec. 18, 2015.

(51) Int. Cl.

| | |
|---|---|
| ***B05B 7/30*** | (2006.01) |
| ***B05B 15/30*** | (2018.01) |
| ***B05B 11/00*** | (2006.01) |
| ***B05B 15/00*** | (2018.01) |

(52) U.S. Cl.

CPC ..... *B05B 7/30* (2013.01); *B05B 11/0054* (2013.01); *B05B 11/3057* (2013.01); *B05B 11/3081* (2013.01); *B05B 15/005* (2013.01); *B05B 15/30* (2018.02)

(58) Field of Classification Search

CPC ... B05B 7/30; B05B 11/0054; B05B 11/3081; B05B 15/005

USPC ..... 222/136, 145.5

See application file for complete search history.

(56) References Cited

U.S. PATENT DOCUMENTS

| | | | | |
|---|---|---|---|---|
| 3,704,814 | A * | 12/1972 | Ruscitti | B65D 83/682 222/136 |
| 3,786,963 | A * | 1/1974 | Metzler, III | B05B 11/3081 222/136 |
| 4,279,362 | A | 7/1981 | Pursell | |
| 5,819,987 | A | 10/1998 | Miller | |
| 6,540,109 | B1 | 4/2003 | Klima et al. | |
| 8,777,065 | B2 | 7/2014 | Knopow et al. | |
| 8,925,766 | B2 | 1/2015 | Gray et al. | |
| 2009/0277928 | A1* | 11/2009 | Bruckner | B05B 11/0078 222/129 |
| 2012/0066839 | A1* | 3/2012 | Man | C11D 1/37 8/137 |
| 2012/0255973 | A1 | 10/2012 | Schlueter et al. | |
| 2014/0110434 | A1 | 4/2014 | Ciavarella et al. | |
| 2015/0252302 | A1* | 9/2015 | Rieth | C11D 3/2072 514/772 |
| 2016/0310977 | A1 | 10/2016 | Arvanitidoou et al. | |

* cited by examiner

*Primary Examiner* — Donnell Long

(57) ABSTRACT

A dispenser includes a housing, a cartridge, and a pump assembly. The housing has a first liquid disposed therein, and the cartridge has a second liquid disposed therein. The pump assembly includes a tube. The first liquid is drawn from the housing into the tube through a first inlet in the tube when the pump assembly is actuated, and the second liquid is drawn from the cartridge into the tube through a second inlet in the tube when the pump assembly is actuated. The first and second liquids are combined within the tube to form a mixture.

18 Claims, 1 Drawing Sheet

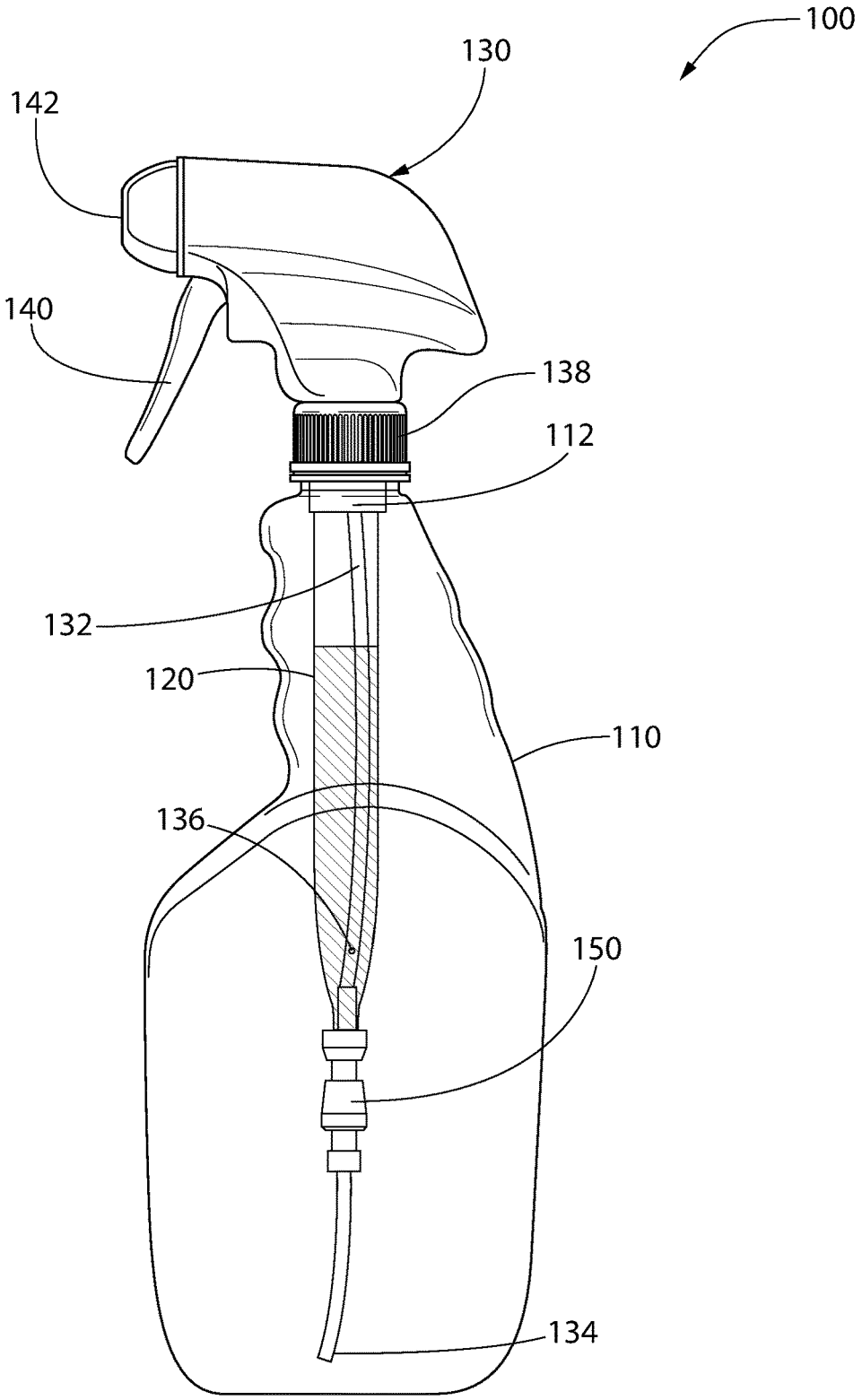
100
130
142
140
138
112
132
120
110
136
150
134

DISPENSER FOR CONCENTRATED CLEANING SOLUTION

CROSS-REFERENCE TO RELATED APPLICATIONS

This application claims priority to U.S. Provisional Patent Application No. 62/269,414, filed on Dec. 18, 2015, the disclosure of which is incorporated by reference herein in its entirety.

BACKGROUND

A home care cleaning solution is typically sold in a dispenser that includes a housing and a pump assembly. A pre-mixed cleaning solution is disposed within the housing. When a user actuates the pump assembly, the cleaning solution flows (e.g., sprays) out through a nozzle in the pump assembly.

In another embodiment, the user may pour a measured amount of concentrated cleaning solution into the housing through a first end of the housing, and pour a measured amount of water into the housing through a second end of the housing. The concentrated cleaning solution and water mix together in the housing. After mixing occurs, a user may actuate the pump assembly, causing the mixture to flow out through the nozzle in the pump assembly. When the mixture is exhausted, the user may pour additional measured amounts of concentrated cleaning solution and/or water into the housing, so that the dispenser may continue to be used. What is needed, however, is an improved system and method for refilling a dispenser after the cleaning solution is exhausted.

BRIEF SUMMARY

A dispenser is disclosed. The dispenser includes a housing, a cartridge, and a pump assembly. The housing has a first liquid disposed therein, and the cartridge has a second liquid disposed therein. The pump assembly includes a tube. The first liquid is drawn from the housing into the tube through a first inlet in the tube when the pump assembly is actuated, and the second liquid is drawn from the cartridge into the tube through a second inlet in the tube when the pump assembly is actuated. The first and second liquids are combined within the tube to form a mixture.

A method for using a dispenser is also disclosed. The method includes pouring a first liquid into a housing. A cartridge is then coupled to a pump assembly. The cartridge has a second liquid disposed therein. A tube of a pump assembly is then inserted into the housing to place a first inlet of the tube in contact with the first liquid in the housing. A second inlet of the tube is in contact with the second liquid in the cartridge.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein:

FIG. 1 depicts a perspective view of an example of a dispenser including a housing, a cartridge, and a pump assembly.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

FIG. 1 depicts a perspective view of an example of a dispenser 100 including a housing 110, a cartridge 120, and a pump assembly 130. The dispenser 100 may be used to dispense a cleaning solution such as, for example, Fabuloso® produced by the Colgate-Palmolive Company. In other embodiments, the dispenser 100 may be used to dispense other liquids, such as bathroom cleaners, window cleaners, degreasers, body wash, facial cleanser, hair care or styling products, surface cleaner detergents, hand sanitizers, skin moisturizers, cosmetic or therapeutic skin products, or the like.

The housing 110 may define an internal volume. As described in more detail below, a first liquid may be poured into and/or disposed within the internal volume of the housing 110 through an opening 112 in the housing 110. The first liquid may be or include water, surfactant, or a combination thereof.

The cartridge 120 may be inserted into the internal volume of the housing 110 through the opening 112 in the housing 110. In another embodiment, the cartridge 120 may be coupled to the housing 110, but inserted into the internal volume of the housing 110 through a separate opening other than the opening 112 in the housing 110. In yet another embodiment, the cartridge 120 may be coupled to, but positioned outside of, the housing 110. The cartridge 120 may also define an internal volume, and a second liquid may be poured into and/or disposed within the internal volume of the cartridge 120. The second liquid may be or include a concentrated cleaning solution (e.g., soap), a fragrance, an anti-bacterial liquid, a moisturizer, or a combination thereof.

The pump assembly 130 may include a tube 132, a lid 138, an actuator 140, and an outlet (e.g., a nozzle) 142. As shown, the tube 132 may be introduced into the internal volume of the housing 110 through the opening 112 in the housing 110. Once the tube 132 is positioned within the internal volume of the housing 110, the lid 138 may be coupled to the upper end of the housing 110 (e.g., proximate to the opening 112 in the housing 110) via a screw thread, a bayonet-style twist lock, a press fit, a hinged latch, an elastomeric seal, or a combination thereof. This may form a substantially "water-tight" seal between the lid 138 and the housing 110.

The pump assembly 130 may also be coupled to the cartridge 120 and/or positioned at least partially within the internal volume of the cartridge 120. As shown, the tube 132 of the pump assembly 120 may extend through the internal volume of the cartridge 120, and the cartridge 120 and the tube 132 may both be positioned at least partially within the internal volume of the housing 110. The lower end of the tube 132 may extend through the lower portion of the cartridge 120 such that the lower end of the tube 132 is positioned within the internal volume of the housing 110, but not within the internal volume of the cartridge 120.

The tube 132 may include a first inlet (e.g., an opening) 134. As shown, the first inlet 134 may be an axial opening formed through the lower end of the tube 132. The first inlet 134 may provide a path of fluid communication between the internal volume of the housing 110 and the internal volume (e.g., a bore) of the tube 132. When the actuator 140 is actuated (e.g., squeezed), the first liquid (e.g., water) may drawn from the internal volume of the housing 110, through the first inlet 134, and into the tube 132.

The tube 132 may also include a second inlet (e.g., opening) 136. As shown, the second inlet 136 may be a radial opening formed through the tube 132. The second inlet 136 may be positioned between the first inlet 134 and the lid 138. The second inlet 136 may provide a path of fluid communication between the internal volume of the cartridge 120 and the internal volume (e.g., the bore) of the tube 132. When the actuator 140 is actuated (e.g., squeezed), the second liquid (e.g., concentrated cleaning solution) may be drawn from the internal volume of the cartridge 120, through the second inlet 136, and into the tube 132.

A valve 150 may be coupled to and/or positioned at least partially within the tube 132. The valve 150 may be a one-way valve that allows the first liquid (e.g., water) to flow upward therethrough. The valve 150, however, may prevent the second liquid (e.g., concentrated cleaning solution) from flowing downward therethrough. As may be appreciated, this may prevent the second liquid from flowing downward through the first inlet 134 and mixing with the first liquid in the internal volume of the housing 110.

In operation, a user may actuate (e.g., squeeze) the actuator 140 of the pump assembly 130, causing the first liquid (e.g., water) in the internal volume of the housing 110 to be drawn into the tube 132 through the first inlet 134 of the tube 132. The actuation of the pump assembly 130 may simultaneously cause the second liquid (e.g., concentrated cleaning solution) in the cartridge 120 to be drawn into the tube 132 through the second inlet 136 of the tube 132. The first and second liquids may be combined and/or mixed (e.g., on demand) to form a mixture in the internal volume of the tube 132. The mixture may be ejected (e.g., sprayed) from the dispenser 100 through the outlet 142 of the pump assembly 130.

When the first liquid (e.g., water) in the housing 110 is exhausted, the user may decouple the lid 138 from the housing 110 and pour additional first liquid into the internal volume housing 110 through the opening 112 in the housing 110. In some embodiments, the housing 110 may include a marking that indicates the maximum fill level in the housing 110. The user may then re-couple the lid 138 to the housing 110. In another embodiment, the user may refill the housing 110 with the first liquid when the first liquid is only partially used up (i.e., there is still enough water in the housing 110 for the dispenser 100 to operate).

When the second liquid (e.g., concentrated cleaning solution) in the cartridge 120 is at least partially exhausted, the user may decouple the lid 138 from the housing 110 and pull the tube 132 and the cartridge 120 out of the internal volume of the housing 110. The cartridge 120 may then either be discarded or refilled with additional second liquid. The tube 132 and the new or refilled cartridge 120 may then be inserted back into the internal volume of the housing 110 through the opening 112 in the housing 110 such that the first inlet 134 is submerged in the first liquid, and the lid 138 may be re-coupled to the housing 110. In another embodiment, the user may refill or replace the cartridge 120 when the second liquid is only partially used up (i.e., there is still enough concentrated cleaning solution in the cartridge 120 for the dispenser 100 to operate).

The dispenser 100 may be designed such that a ratio of the mixture of the first liquid (e.g., water) to the second liquid (e.g., concentrated cleaning solution) is within a predetermined range. In one embodiment, a ratio of the first liquid to the second liquid (e.g., water:concentrated cleaning solution) may be from about 7:1 to about 50:1. For example, the ratio may be from about 7:1 to about 10:1, about 10:1 to about 20:1, or about 20:1 to about 50:1. The ratio may depend at least partially upon the viscosity of the first and second liquids as well as the size (e.g., radius) of the first and second inlets 134, 136. The dispenser 100 may also be designed such that the mixture has a predetermined flow rate within the tube 132 and/or out of the outlet 142. The flow rate of first liquid within the tube 132, the second liquid within the tube 132, and/or the mixture within the tube 132 may depend at least partially upon the length of the tube 132, the inner diameter of the tube 132, and the viscosity of the first and second liquids.

In one embodiment, the flow rate of the first liquid (e.g., water) inside the tube 132 may be determined using Darcy's Equation (1) below:

$$\Delta p=(8\rho fLQ^2)/(\pi^2D^5) \quad (1)$$

where Δp represents the pressure drop in the fluid due to friction in the tube 132, ρ represents the density of the fluid, f represents the friction coefficient, L represents the length that the fluid travels in the tube 132, Q represents the volumetric flow rate of the fluid, and D represents the internal diameter of the tube 132. In one embodiment, $f=64/Re$ for laminar flow, and $f=0.3164/(Re)^{1/4}$ for turbulent flow in smooth tubes, where Re represents Reynolds number.

These values may be used in Equation (2) below:

$$Re=\rho vD/\mu \quad (2)$$

Where ρ still represents the density of the fluid, v represents the velocity of the fluid, D still represents the internal diameter of the tube 132, and μ represents the dynamic viscosity of the fluid.

When referring to the first liquid, Δp represents the pressure drop as the first liquid enters the tube 132 through the first inlet 134, ρ represents the density of the first liquid, f represents the friction coefficient as the first liquid flows through the tube 132, L represents the distance that the first liquid travels in the tube 132 before reaching the point where the first and second liquids meet/mix, Q represents the volumetric flow rate of the first liquid, and D represents the internal diameter of the tube 132. More particularly, L may be the axial distance along the tube 132 between the first and second inlets 134, 136 because the first and second liquids both flow upwards within the tube 132 after entering the tube 132.

In one example, the length L may be 30 mm, and the internal diameter D of the tube 132 may be 2.5 mm. Using these values, Equation (1) may indicate that the flow rate Q of the first liquid within the tube 132 is about 28 mL/s. However, when the valve 150 is present, the valve 150 may regulate the flow. The length of the flowpath through the valve 150 may be about 3 mm and the internal diameter through the valve 150 may be about 0.7 mm. As a result, the flow rate of the first liquid through the valve 150 may be about 3.3 mL/s.

When referring to the second liquid, Δp represents the pressure drop as the second liquid enters the tube 132 through the second inlet 136, ρ represents the density of the second liquid, f represents the friction coefficient as the second liquid flows through the tube 132, L represents the distance that the second liquid travels through the second inlet 136 in the tube 132 before reaching the point where the first and second liquids meet/mix, Q represents the volumetric flow rate of the second liquid, and D represents the internal diameter of the inlet 136 of the tube 132. More particularly, L may be the radial thickness of the wall of the tube 132 because the second liquid may meet/mix with the first liquid once the second liquid reaches the bore of the tube 132.

As will be appreciated, Equation (1) may not account for one or more variables that affect the flow rates of the liquids. Such variables may include the differences in head pressure between the two liquids, roughness of the inner surface of the tube 132, extra complexities of lamellar and turbulent flow, unique internal geometries of the valve 150, etc. In an example, in response to actuation of the actuator 140, 1.06 grams of the first liquid (e.g., water) may be drawn into the tube 132, and 0.17 grams of the second liquid (e.g., concentrated cleaning solution) may be drawn into the tube 132. Thus, the mixture exiting the outlet 142 may include 86.2% of the first liquid and 13.8% of the second liquid. In this example, 53.7% of the second liquid may be or include surfactant+glycol ethers. The remaining 46.3% of the second liquid may be or include water, alcohol, fragrance, etc. As a result, 7.4% of the mixture exiting the outlet 142 may include surfactant+glycol ethers.

In at least one embodiment, mixtures containing greater than or equal to a predetermined amount of surfactant+glycol ethers may increase in viscosity when diluted with water. For example, a mixture containing sodium lauryl ether sulfate may be a pourable liquid when the mixture contains 70% sodium lauryl ether sulfate and 30% water, but the mixture may become a high viscosity gel when the mixture contains 50% sodium lauryl ether sulfate and 50% water. Further dilution with water may result in a free-flowing liquid with sufficient mixing and/or time. When being used in a dispenser 100 configured to spray the mixture, the mixture may have a viscosity that is high enough so that the mixture does not form a gel within the tube 132. Static mixers or other in-line dispersion techniques may be used for mixtures that do not gel, but require added turbulence or mixing time. Increasing the length and/or volume of the tube 132 may also aid in the dispersion by providing additional time for mixing.

The ingredients for an illustrative second liquid (e.g., concentrated cleaning solution) are provided in Table 1 below. This particular concentrated cleaning solution may be used to remove grease (i.e., a "degreaser").

TABLE 1

| Material | RM Active % | $2^{nd}$ Liquid as is % | $2^{nd}$ Liquid Active % |
|---|---|---|---|
| Demineralized water | 100.0 | 13.1 | 13.1 |
| NaLAS | 52.5 | 47.2 | 24.8 |
| 38% $NA_2O$ Caustic Soda | 38.0 | 0.0 | 0.0 |
| Tamadol 91-2.5 | 100.0 | 2.9 | 2.9 |
| Propylene Glycol N-Butyl Ether | 100.0 | 12.4 | 12.4 |
| Dipropylene Glycol Monobutyl ether | 100.0 | 12.4 | 12.4 |
| Neodol 91-8 | 100.0 | 1.2 | 1.2 |
| $SD_3A$ Alcohol | 96.0 | 8.3 | 8.1 |
| Fragrance | 100.0 | 2.6 | 2.6 |

The RM (i.e., raw material) Active % refers to the percentage of the raw material that is active (e.g., not solvent or other non-active materials). For example, if a user starts with 100 grams of NaLAS, 52.5 grams of the NaLAS raw material may be active surfactant, while the remaining 47.5 grams of the NaLAS raw material may be solvent or other inactive materials. In one embodiment, "active" may refer to the active matter in a raw material that contains inactive materials such as solvent. In another embodiment, "active" may refer to the active material in a finished formula, such as NaLAS, glycol ethers and Nonionic surfactant (i.e., Neodol 91-8, Tamadol 91-2.5) in this example.

The $2^{nd}$ Liquid as is % refers to the percentage of that particular material in the second liquid. For example, if a user has 100 grams of the second liquid, then 47.2 grams of the second liquid may be a solution of NaLAS containing 24.8 grams of active NaLAS and 22.4 grams of solvent or other inactive materials.

The $2^{nd}$ Liquid Active % refers to the percentage of particular material in the second liquid that is active. For example, if the NaLAS is 52.5% active, and the second liquid contains 47.2 grams of NaLAS (out of 100 total grams), then the second liquid contains 24.8 grams of the active portion of the NaLAS.

What is claimed is:

1. A dispenser, comprising:

a housing having a first liquid disposed therein;

a cartridge having a second liquid disposed therein, wherein the cartridge is positioned within the housing; and a pump assembly comprising a tube, wherein the tube comprises a first inlet and a second inlet, wherein the tube extends through the cartridge;

wherein the first liquid is drawn from the housing into the tube through the first inlet in the tube when the pump assembly is actuated, wherein the second liquid is drawn from the cartridge into the tube through the second inlet in the tube when the pump assembly is actuated, and wherein the first and second liquids are combined within the tube to form a mixture.

2. The dispenser of claim 1, further comprising a valve coupled to the tube that allows the first liquid to pass therethrough in a first direction but prevents the second liquid from passing therethrough in a second, opposing direction.

3. The dispenser of claim 2, wherein the first inlet is an axial opening, wherein the second inlet is a radial opening, and wherein the first inlet is positioned below the second inlet.

4. The dispenser of claim 3, wherein the first inlet and the second inlet are sized such that a ratio of the first liquid to the second liquid in the mixture is from about 7:1 to about 50:1.

5. The dispenser of claim 1, wherein the first liquid comprises water, surfactant, or a combination thereof, and wherein the second liquid comprises a concentrated cleaning solution, a fragrance, an anti-bacterial liquid, a moisturizer, or a combination thereof.

6. The dispenser of claim 1, wherein more than half of the second liquid comprises a surfactant, a glycol ether, or a combination thereof.

7. The dispenser of claim 6, wherein less than 10% of the mixture comprises the surfactant, the glycol ether, or the combination thereof.

8. The dispenser of claim 1, wherein the second liquid comprises water, sodium linear alkylbenzene sulfonate, sodium oxide, a non-ionic surfactant, propylene glycol n-butyl ether, dipropylene glycol monobutyl ether, an emulsifier, a denatured alcohol, and a fragrance.

9. A method for using a dispenser, comprising:

pouring a first liquid into a housing;

coupling a cartridge to a pump assembly comprising a tube comprising a first inlet and a second inlet, wherein the cartridge has a second liquid disposed therein and wherein the cartridge is positioned within the housing; and inserting the tube of the pump assembly into the housing to place the first inlet of the tube in contact with the first liquid in the housing, wherein the second inlet of the tube is in contact with the second liquid in the cartridge and wherein the tube extends through the cartridge.

10. The method of claim 9, further comprising:

actuating the pump assembly, thereby causing:

the first liquid to be drawn from the housing into the tube through the first inlet in the tube; and the second liquid to be drawn from the cartridge into the tube through the second inlet in the tube, such that the first liquid and the second liquid are combined inside the tube.

11. The method of claim 10, further comprising pouring the second liquid into the cartridge prior to inserting the tube of the pump assembly into the housing.

12. The method of claim 11, wherein the cartridge is coupled to the tube, and wherein the cartridge is inserted into the housing when the tube is inserted into the housing.

13. The method of claim 12, further comprising:

removing the cartridge and the tube from the housing;

pouring an additional amount of the first liquid into the housing; and re-inserting the cartridge and the tube into the housing after the additional amount of the first liquid has been poured into the housing.

14. The method of claim 12, further comprising:

removing the cartridge and the tube from the housing;

pouring an additional amount of the second liquid into the cartridge; and re-inserting the cartridge and the tube into the housing after the additional amount of the second liquid has been poured into the cartridge.

15. The method of claim 9, wherein the pump assembly comprises a valve coupled to the tube that allows the first liquid to pass therethrough in a first direction but prevents the second liquid from passing therethrough in a second, opposing direction.

16. The method of claim 9, wherein the first inlet and the second inlet are sized such that a ratio of the first liquid to the second liquid in the mixture is from about 7:1 to about 50:1.

17. The method of claim 9, wherein more than half of the second liquid comprises a surfactant, a glycol ether, or a combination thereof, and wherein less than 10% of the mixture comprises the surfactant, the glycol ether, or the combination thereof.

18. The method of claim 9, wherein the second liquid comprises water, sodium linear alkylbenzene sulfonate, sodium oxide, a non-ionic surfactant, propylene glycol n-butyl ether, dipropylene glycol monobutyl ether, an emulsifier, a denatured alcohol, and a fragrance.

* * * * *